US011261714B2

(12) United States Patent
Beliaeva et al.

(10) Patent No.: US 11,261,714 B2
(45) Date of Patent: Mar. 1, 2022

(54) SYSTEM AND METHOD FOR REMOVING SUBSTANCES FROM HORIZONTAL WELLS

(71) Applicant: Ellina Beliaeva, Mexico City (MX)

(72) Inventors: Ellina Beliaeva, Mexico City (MX); Victor Fairuzov, Albuquerque, NM (US)

( * ) Notice: Subject to any disclaimer, the term of this patent is extended or adjusted under 35 U.S.C. 154(b) by 59 days.

(21) Appl. No.: 16/772,152

(22) PCT Filed: Dec. 11, 2018

(86) PCT No.: PCT/IB2018/001617
§ 371 (c)(1),
(2) Date: Jun. 11, 2020

(87) PCT Pub. No.: WO2019/116109
PCT Pub. Date: Jun. 20, 2019

(65) Prior Publication Data

US 2021/0071506 A1 Mar. 11, 2021

Related U.S. Application Data

(60) Provisional application No. 62/597,030, filed on Dec. 11, 2017.

(51) Int. Cl.
*E21B 43/12* (2006.01)
*E21B 34/08* (2006.01)

(52) U.S. Cl.
CPC ..... *E21B 43/123* (2013.01); *E21B 34/08* (2013.01); *E21B 43/126* (2013.01); *E21B 43/128* (2013.01)

(58) Field of Classification Search
CPC ..... E21B 43/13; E21B 43/121; E21B 43/122; E21B 43/123; E21B 43/126; E21B 43/128; E21B 43/129; E21B 34/08; E21B 34/085; E21B 34/101
See application file for complete search history.

(56) References Cited

U.S. PATENT DOCUMENTS

| | | | | |
|---|---|---|---|---|
| 3,894,814 | A * | 7/1975 | Morgan | E21B 43/121 417/121 |
| 4,527,633 | A * | 7/1985 | McLaughlin | B09C 1/002 166/370 |
| 6,672,392 | B2 * | 1/2004 | Reitz | E21B 43/121 166/372 |
| 2009/0223662 | A1 * | 9/2009 | Shaw | E21B 43/38 166/250.15 |
| 2013/0098629 | A1 * | 4/2013 | Wilson | E21B 17/203 166/372 |
| 2013/0277063 | A1 * | 10/2013 | Palka | E21B 43/121 166/370 |

* cited by examiner

*Primary Examiner* — David Carroll
(74) *Attorney, Agent, or Firm* — Michael D. Eisenberg

(57) ABSTRACT

An apparatus of removing substances from horizontal wells drilled from a surface comprises: a casing, a tubing disposed within the casing, a downhole pump connected to an end of the tubing, and a production conduit attached to the downhole pump. The apparatus has a gas containing section of the well that leads to the production conduit. The gas containing section is configured to accumulate a first predetermined volume of gas. An annular space is formed by the casing, tubing and production conduit. A first one-way valve is disposed within the production conduit and that leads to the annular space. A first vessel contains a working fluid. The first vessel is in fluid communication with the first one way valve.

20 Claims, 11 Drawing Sheets

SYSTEM AND METHOD FOR REMOVING SUBSTANCES FROM HORIZONTAL WELLS

CROSS REFERENCES TO RELATED APPLICATIONS

This application claims priority from U.S. Provisional Application Ser. No. 62/597,030 filed Dec. 11, 2017, which is hereby incorporated herein by reference in its entirety.

TECHNICAL FIELD

This disclosure is directed to increasing hydrocarbon production from wells, and in particular to increasing hydrocarbon production using artificial lift systems.

BACKGROUND

Artificial lift is a process used to increase the flow of liquids, such as crude oil and/or water, from a production well. Conventional artificial lift methods and devices, such as a downhole pump or a plunger, are designed to be placed in a vertical oil or gas well. Placing the downhole pump in a deviated section of a horizontal well results in high operating costs due to pump failures, high back pressure on the reservoir, and a poor liquid lift efficiency due to gas interference in the pump (incomplete pump "fillage"). In wells with plunger lift systems, the deviation can affect adversely plunger performance, even at low inclinations (10-20°) from the vertical.

Palka discloses in U.S. Pat. No. 9,500,067 a method for a downhole pumping system designed to cyclically decrease and increase gas pressure in the casing annulus (i.e., the annular space surrounding the downhole pump and tubing connecting the pump to the surface). Production of fluid from the reservoir is increased during the cycling decrease in casing annuals pressure, and production of fluid from the downhole pump is increased during the cycling decrease in casing annular pressure. The method can be applied to horizontal wells, but the method has several known disadvantages. The increase in the flow rate of the liquids located between the downhole pump and the horizontal section of the horizontal well (i.e., the heel section) is limited by the ability of a reservoir to deliver fluids to the wellbore (i.e., the productivity index). The liquids may not be removed from the heel section into the casing annulus during the cycling decrease in casing annulus pressure in wells with a low productivity index, even if casing annulus pressure is reduced to zero. The improvement in the pump efficiency (the pump "fillage") is limited, since the liquids quickly flow back into the heel section from the casing annulus during the cycling increase in casing annulus pressure. Furthermore, the Palka disclosure cannot be applied to horizontal wells using plunger lift.

BRIEF SUMMARY OF EMBODIMENTS OF THE INVENTION

An apparatus of removing substances from a horizontal well drilled from a surface comprises: a casing; a tubing disposed within the casing; a downhole pump connected to an end of the tubing; a production conduit attached to the downhole pump; a gas containing section of the well that leads to the production conduit, the gas containing section configured to accumulate a first predetermined volume of gas; an annular space formed by the casing, tubing and production conduit; and a first one-way valve disposed within the production conduit and that leads to the annular space. The apparatus has a first vessel that contains a working fluid. The first vessel is in fluid communication with the first one way valve. The apparatus is configured to: displace a predetermined amount of one or more substances from the production conduit through the first one-way valve into the annular space by the first predetermined volume of gas and the first predetermined volume of gas is discharged into the production conduit and wherein the working fluid is displaced from the first vessel by a second predetermined volume of gas entering the first vessel from the annular space; pump the predetermined amount of one or more substances from the annular space into the tubing via the downhole pump; and release the first predetermined volume of gas into the annular space through the first one-way valve, once pressure in the production conduit becomes sufficiently high, which allows a substantially amount of the first predetermined volume of gas to rise up through the annular space towards the surface.

In a variant, the production conduit has a flow opening comprising perforations, located between the downhole pump and a sealing mechanism, comprising a packer disposed between the production conduit and a well conduit. The one-way valve is configured to allow one or more liquids to flow from the production conduit through valve and then through perforations toward the annular space, but substantially prevents the flow of one or more liquids in an opposite direction.

In another variant, the casing and tubing fluidly communicates with a fluid-receiving conduit at the surface. A second one-way valve is disposed between casing and fluid-receiving conduit and is configured to limit the pressure in the annular space such that it does not exceed a predetermined maximum casing pressure. The second one-way valve is configured to allow the first predetermined volume of gas to flow from the annular space toward the fluid-receiving conduit, but substantially prevents the flow of the first predetermined volume of gas and one or more liquids in an opposite direction.

In a further variant, the first vessel has an upper end and a lower end. A second vessel has a lower portion and an upper portion. A connecting line is connected in parallel with a bypass line. An opening is disposed in the upper portion of second vessel. A connecting line is provided with a third one-way valve and a working-fluid pump. A bypass line is connected in parallel with the connecting line and the bypass line having a first on/off valve. The upper end of first vessel fluidly communicates with casing at the surface and the lower end of first vessel fluidly communicates with the lower part of second vessel via the connecting line. The third one-way valve is configured to allow the working fluid to flow from the second vessel toward the first vessel, but substantially prevent the flow of working fluid in an opposite direction. The second vessel fluidly communicates with Earth's atmosphere or with a reduced pressure environment through an opening.

In still another variant, the production conduit is attached and fluidly connected to the casing. A lower end of the production conduit is connected to the gas-containing section and the annular space extends from the first one-way valve up to the surface.

In yet a further variant, a third one-way valve is configured to allow the working fluid to flow from the first vessel toward a second vessel, but substantially prevents the flow of the working fluid in an opposite direction. A working-fluid pump comprises pumping the working fluid from the first vessel through a connecting line into the second vessel.

In a variant, a method of removing substances from a well comprises: displacing a predetermined amount of one or more substances from a production conduit through a first one-way valve into an annular space by a first predetermined volume of gas and discharging the first predetermined volume of gas into the production conduit; displacing a working fluid from a first vessel by a second predetermined volume of gas entering the first vessel from the annular space; pumping the predetermined amount of one or more substances from the annular space into a tubing via a downhole pump; and releasing the first predetermined volume of gas into the annular space through the first one-way valve, once pressure in the production conduit becomes sufficiently high, which allows a substantial amount of the first predetermined volume of gas to rise up through and out of the annular space.

In another variant of the method, the first predetermined volume of gas is discharged into the production conduit by suctioning the second predetermined volume of gas from the annular space to produce a low pressure in the annular space. A first on/off valve is kept closed and the working fluid is pumped from the first vessel through connecting line into a second vessel by a working-fluid pump.

In a further variant of the method, the first on/off valve is kept substantially opened and the working fluid is transported through a bypass line from the second vessel into the first vessel to displace a substantial amount of the second predetermined volume of gas back into the annular space.

In still another variant, an apparatus of removing substances from a horizontal well drilled from a surface comprises: a substantially horizontal section of the well; a casing; a tubing disposed within the casing. The tubing has an inlet opening disposed at an end nearest the horizontal section of the well. A production conduit is attached to the tubing nearest the horizontal section of the well, wherein the production conduit and tubing fluidly communicates with each other through inlet opening. A fourth one-way valve is disposed at the end of tubing nearest horizontal section above the inlet opening, wherein the fourth one-way valve is configured to allows a first predetermined volume of gas and/or one or more liquids, when present, to flow from the production conduit, but substantially prevent the flow of the first predetermined volume of gas and/or one or more liquids, when present, in the opposite direction. A downhole bumper spring is disposed within the tubing above the fourth one-way valve. A plunger is slidably disposed within tubing, wherein downward movement of the plunger is limited by the downhole bumper spring. An annular space is formed by the casing, tubing and production conduit. A first one-way valve is disposed within the production conduit and that leads to the annular space. A first vessel contains a working fluid and the first vessel in fluid communication with the first one way valve. The apparatus is configured to permit the first predetermined volume of gas to enter the tubing through the inlet opening and continue to rise up through the fourth one-way valve and downhole bumper spring toward the surface, where it flows out into fluid-receiving conduit. The first predetermined volume of gas substantially does not flow through the annular space.

In yet a further variant, the end of the tubing nearest the surface is adapted to limit the upward movement of plunger.

In a variant, at the surface, the tubing and a fluid-receiving conduit are connected through a second on/off valve.

In another variant, the plunger is located at the end of tubing nearest surface.

In a further variant, a method of removing substances from a well comprises: displacing a predetermined amount of one or more substances from a production conduit through a first one way-valve into an annular space gas by a first predetermined volume of gas and discharging the first predetermined volume of gas into the production conduit; displacing a working fluid from a first vessel into a second vessel by a second predetermined volume of gas entering the first vessel from the annular space and reducing the pressure in a gas-containing section; displacing the predetermined amount of one or more substances from the annular space into the tubing; pumping the working fluid through a connecting line into a first vessel to displace a substantial amount of the second predetermined volume of gas back into the annular space such that the one or more substances and first predetermined volume of gas accumulate in the gas-containing section and production conduit. A plunger falls to a downhole bumper spring and at least some of the predetermined amount of one or more substances becomes located above the plunger. Once pressure in the production conduit below the one-way valve becomes sufficiently high, the one-way valve opens, allowing the first predetermined volume of gas to enter the annular space. When a sufficient amount of the first predetermined volume of gas is accumulated and a sufficient pressure is reached in the gas-containing section, production conduit, and annular space, the first predetermined volume of gas enters through the tubing and pushes the plunger upward from the downhole bumper spring toward the surface. At least some of the predetermined amount of one or more substances above the moving plunger moves up tubing such that one or more substances are substantially removed from the tubing and into the fluid-receiving conduit.

In still another variant of the method, a first on/off valve is kept sufficiently open such that the working fluid is displaced from the first vessel through a bypass line and into a second vessel by the first predetermined volume of gas entering the first vessel from the annular space and the pressure in the gas-containing section is reduced.

In yet a further variant of the method, a fraction of the predetermined amount of one or more substances, which is displaced from production conduit enters the tubing through the inlet opening, if a fourth one-way valve is substantially open.

In a variant of the method, displacing the predetermined amount of one or more substances from the annular space comprises displacing the predetermined amount of one or more substances through perforations, an opening, and a fourth one-way valve and into the tubing.

In another variant of the method, pumping the working fluid through a connecting line into a first vessel comprises displacing a substantial amount of the second predetermined volume of gas back into the annular space such that first one-way valve is kept substantially closed.

In yet another variant of the method, a second on/off valve is kept substantially open when displacing the predetermined amount of one or more substances from the annular space into the tubing.

In still a further variant of the method, a second on/off valve is kept substantially closed when the plunger falls to a downhole bumper spring and at least some of the predetermined amount of one or more substances becomes located above the plunger.

BRIEF DESCRIPTION OF THE DRAWINGS

In the drawings, closely related figures have the same number but different alphabetic suffixes.

DETAILED DESCRIPTION OF THE EMBODIMENTS OF THE INVENTION

Figure 1A:
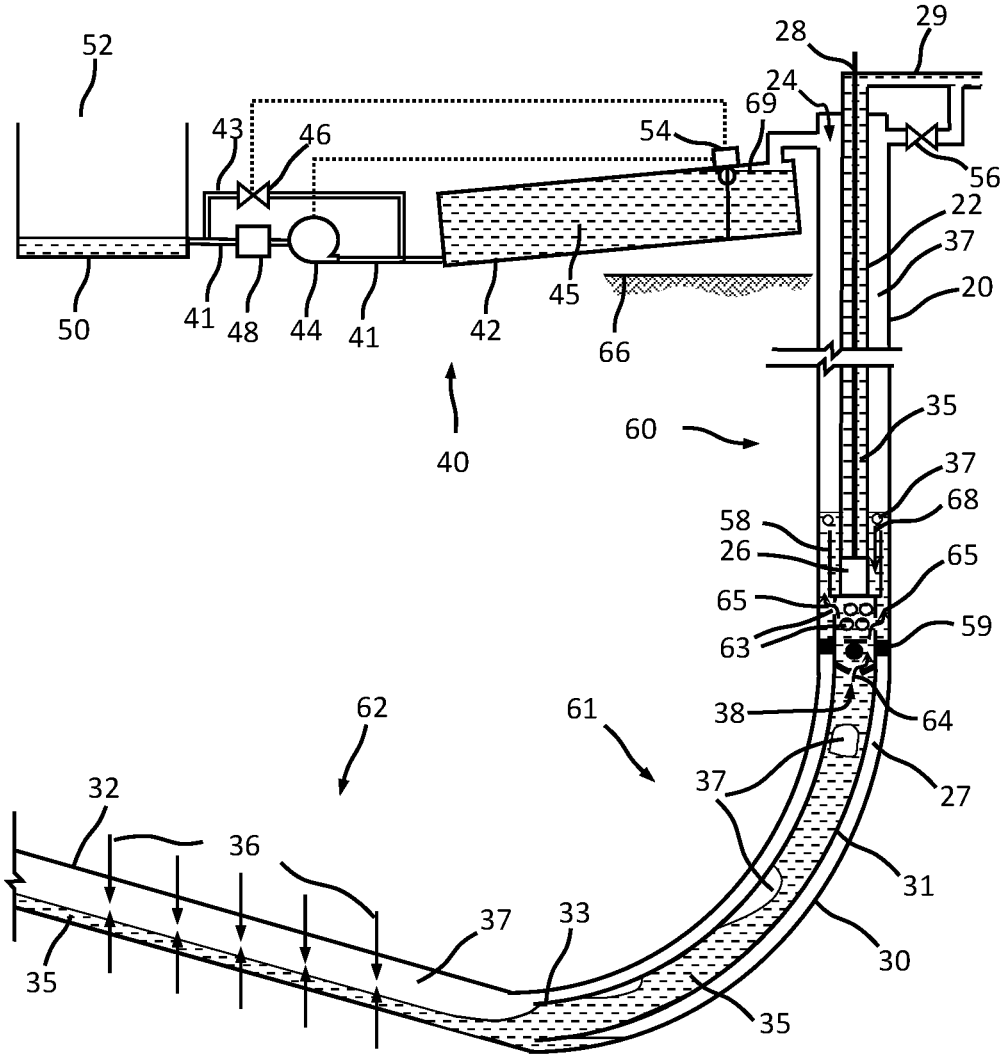
FIG. 1A is a schematic drawing of a first embodiment of a system to remove substances from a horizontal wellbore utilizing a tubing, a casing, a downhole pump, an annular space, a production conduit attached to the downhole pump, and a first one-way valve disposed within the production conduit.

The following reference numerals are used throughout this document.

| REFERENCE NUMERALS | |
|---|---|
| 20 | casing |
| 22 | tubing |
| 24 | annular space |
| 26 | downhole pump |
| 27 | space formed between production conduit and well conduit below packer |
| 28 | sucker rod |
| 29 | fluid-receiving conduit |
| 30 | well conduit |
| 31 | production conduit |
| 32 | gas-containing section |
| 33 | lower end of production conduit |
| 35 | one or more liquids |
| 36 | reservoir fluids |

-continued

| REFERENCE NUMERALS | |
|---|---|
| 37 | first or second predetermined volume of gas |
| 38 | first one-way valve |
| 40 | means for injecting and releasing a second predetermined volume of gas into and out of annular space |
| 41 | connecting line |
| 42 | first vessel |
| 43 | bypass line |
| 44 | working-fluid pump |
| 45 | working fluid |
| 46 | first on/off valve |
| 48 | third one-wave valve |
| 50 | second vessel |
| 52 | opening |
| 54 | controller with working-fluid level sensor |
| 56 | second one-way valve |
| 58 | second tubular member |
| 59 | packer |
| 60 | substantially vertical section |
| 61 | heel section |
| 62 | substantially horizontal section |
| 63 | perforations |
| 64 | direction of flow through first one-wave valve |
| 65 | direction of flow through perforations |
| 66 | surface |
| 68 | direction of flow inside tubular member |
| 69 | working-fluid level |
| 70 | plunger |
| 72 | downhole bumper spring |
| 74 | fourth one-way valve |
| 75 | inlet opening |
| 76 | second on/off valve |
| 66 | surface |

In the description which follows, like elements are marked throughout the specification and drawing with the same reference numerals, respectively. The drawings are not necessarily to scale and certain features may be shown in somewhat schematic or generalized form in the interest of clarity and conciseness.

It should be apparent to those skilled in the art that the use of directional terms such as top, bottom, above, below, upper, lower, upward, downward, etc. are used in relation to the illustrative embodiments as they are depicted in the figures, the upward direction being toward the top of the corresponding figure and the downward direction being toward the bottom of the corresponding figure.

FIG. 1A—First Embodiment

Referring now to FIG. 1A, there is shown a schematic diagram of a horizontal wellbore having a substantially vertical section generally designated by reference numeral 60, a transition section generally designated by reference numeral 61, and a substantially horizontal section generally designated by reference numeral 62 (known in the art as the lateral) which is adapted to receive reservoir fluids 36 from a subterranean reservoir (not shown). Transition section 61 may also be referred to as a heel section 61. Reservoir fluids 36 comprise one or more liquids 35 (e.g., crude oil or condensate and/or water) and a gas 37 (e.g., a natural gas which is produced from the subterranean reservoir or an associated gas which evolves from the crude oil). Vertical section 60 comprises a casing 20, a tubing 22 disposed within casing 20, and a downhole pump 26 (e.g., the sucker rod pump shown in FIG. 1A). Tubing 22 begins at a surface 66, such as the earth's surface for an on-shore application or the sea floor for an off-shore application, and extends to heel section 61. Downhole pump 26 is connected at the end of tubing 22 nearest horizontal section 62. Heel section 61 comprises a well conduit 30 (e.g., an open-hole wellbore or a production casing) and a production conduit 31 (e.g., a first tubular member) disposed within well conduit 30. Production conduit 31 is attached to downhole pump 26 and has a lower end 33 which fluidly communicates with horizontal section 62. Production conduit 31 has a flow opening 63, such as perforations, located between downhole pump 26 and a sealing mechanism 59, such as a packer, which is disposed between production conduit 31 and well conduit 30. Casing 20, tubing 22, and the portion of production conduit 31 between downhole pump 26 and packer 59 form an annular space generally designated by reference numeral 24. Packer 59 separates annular space 24 from a space 27 formed between well conduit 30 and production conduit 31 below packer 59. A sucker rod 28 extends from downhole pump 26 up through tubing 22 to surface 66. In other embodiments (not shown), downhole pump 26 may be any other downhole pump or pumping system suitable for pumping reservoir fluids 36, such as an electric submersible pump, a progressive cavity pump, and the like. Horizontal section 62 of the well comprises a gas-containing section 32 and is configured to provide a substantially horizontal flow or, preferably, a downward inclined flow of reservoir fluids 36. The function of gas-containing section 32 is to accumulate a first predetermined volume of gas 37. Horizontal section 62 may comprise a plurality (not shown) of the gas-containing sections. Also, the cross-sectional area of production conduit 31 may be smaller than that of annular space 24. A first one-way valve 38 (e.g., a standing valve) is disposed within production conduit 31 below perforations 63. Valve 38 allows one or more liquids 35 to flow from production conduit 31 through valve 38, as represented by an arrow 64, and then through perforations 63 toward annular space 24, as represented by arrows 65, but substantially prevents the flow of one or more liquids 35 in the opposite direction. Casing 20 and tubing 22 fluidly communicate with a fluid-receiving conduit 29 (known in the art as the flow line) at surface 66. A second one-way valve 56 is disposed between casing 20 and fluid-receiving conduit 29. Valve 56 allows gas 37 to flow from annular space 24 toward fluid-receiving conduit 29, but substantially prevents the flow of gas 37 and one or more liquids 35 in the opposite direction. A non-limiting example of valve 56 is a relief valve which limits the pressure in annular space 24 such that it does not exceed a predetermined maximum casing pressure.

A means 40 for injecting into and releasing from annular space 24 a second predetermined volume of gas 37 comprises a first vessel 42 (e.g., a tank or a pipe having closed ends) having an upper end and a lower end, a second vessel 50 (e.g., a storage tank) having a lower portion and an upper portion, a working fluid 45 (e.g., water, or one or more liquids 35, or any other suitable liquid-containing fluid), a connecting line 41 which is connected in parallel with a bypass line 43. An opening 52 is disposed in the upper portion of second vessel 50. Connecting line 41 is provided with a third one-way valve 48 and a working-fluid pump 44. Bypass line 43 is provided with a first on/off valve 46. The upper end of first vessel 42 fluidly communicates with casing 20 at surface 66. The lower end of first vessel 42 fluidly communicates with the lower part of second vessel 50 via connecting line 41. Valve 48 allows working fluid 45 to flow from the second vessel 50 toward first vessel 42, but substantially prevents the flow of working fluid 45 in the opposite direction. Second vessel 50 fluidly communicates with the atmosphere or with a reduced pressure environment (not shown) through opening 52.

At an initial operation state, as shown in FIG. 1A, the process may be as follows: reservoir fluids 36 are produced from the reservoir and enter horizontal section 62 where gas 37 separates from one or more liquids 35 and occupies the first predetermined volume in gas-containing section 32. Reservoir fluids 36 rise up through production conduit 31 and then enter annular space 24 through valve 38, as represented by arrow 64, and perforations 63, as represented by arrows 65. Production conduit 31 is mostly filled with one or more liquids 35. Gas 37 continues to rise up through annular space 24 to surface 66 and then flows out of annular space 24 through valve 56 into fluid-receiving conduit 29. One or more liquids 35 from annular space 24 enter downhole pump 26 and are lifted through tubing 22 to fluid-receiving conduit 29. A portion (not shown) of gas 37 may enter tubing 22 through downhole pump 26 from annular space 24. A second tubular member 58 surrounding downhole pump 26 may be provided. It is closed at its lower end and open at its upper end. Its function is to provide a downward flow of one or more liquids 35 toward downhole pump 26 within tubular member 58, as indicated by an arrow 68, thereby to reduce the portion of gas 37 entering downhole pump 26. First vessel 42 is filled with working fluid 45 and valve 46 is closed.

Figure 1B:
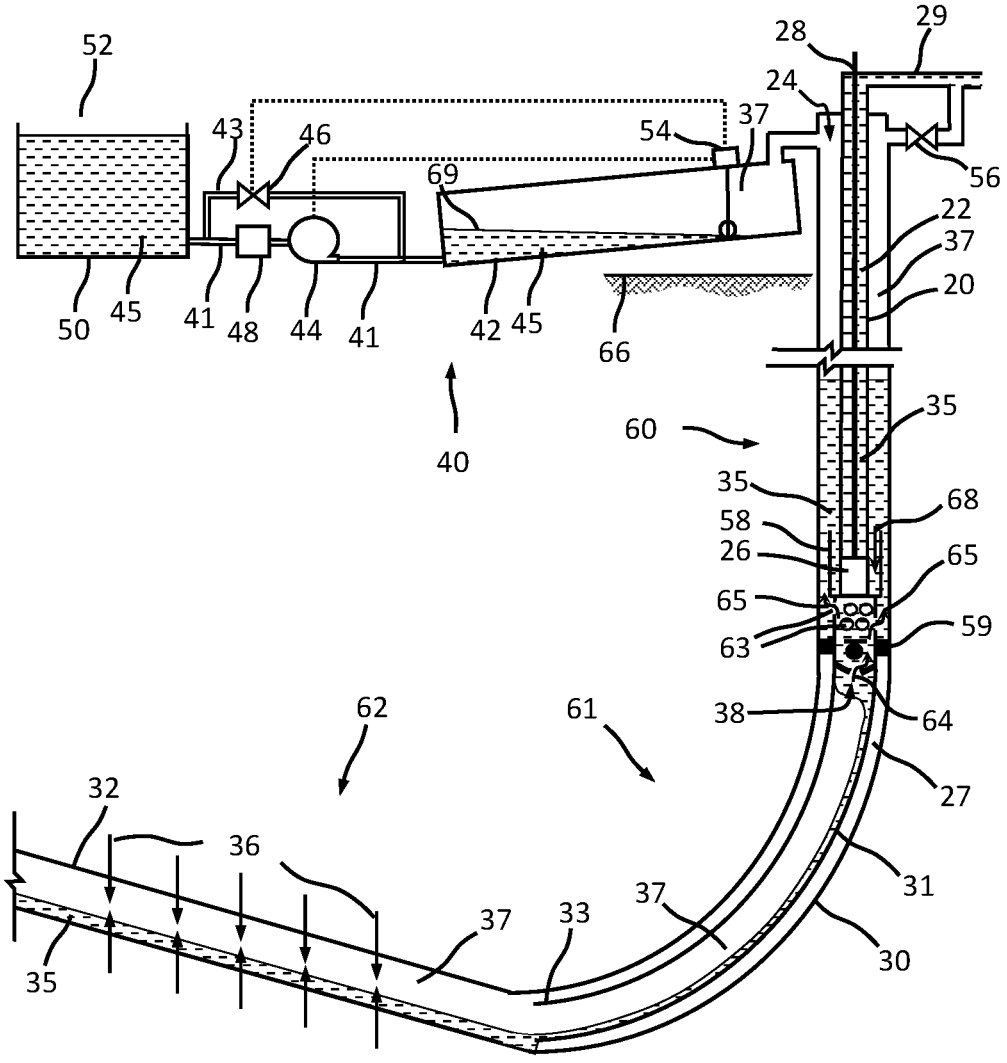
FIG. 1B is a schematic drawing of the first embodiment of FIG. 1A, when a predetermined amount of one or more liquids is displaced from the production conduit through the first one-way valve into the annular space.
Figure 1C:
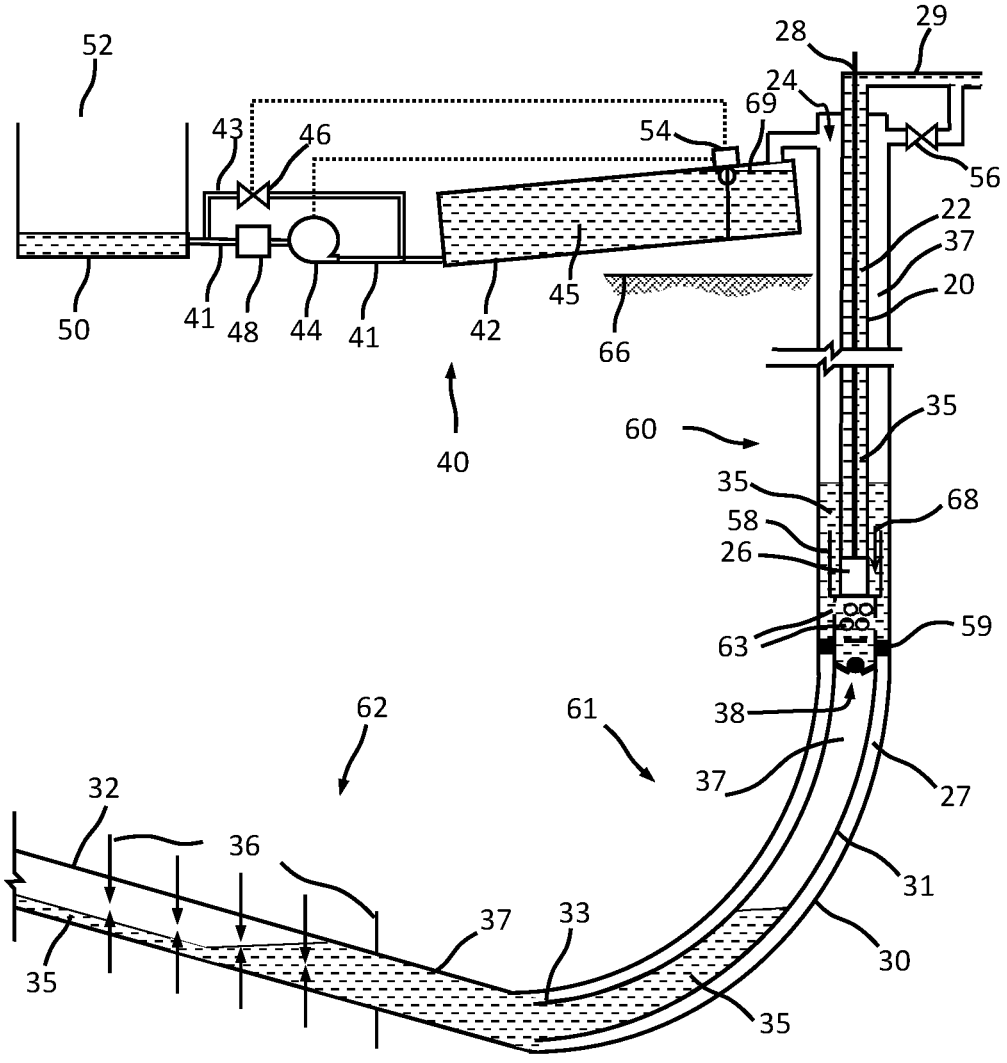
FIG. 1C is a schematic drawing of the first embodiment of FIG. 1A, when the predetermined amount of the one or more liquids is pumped from the annular space into the tubing by the downhole pump.
Figure 1D:
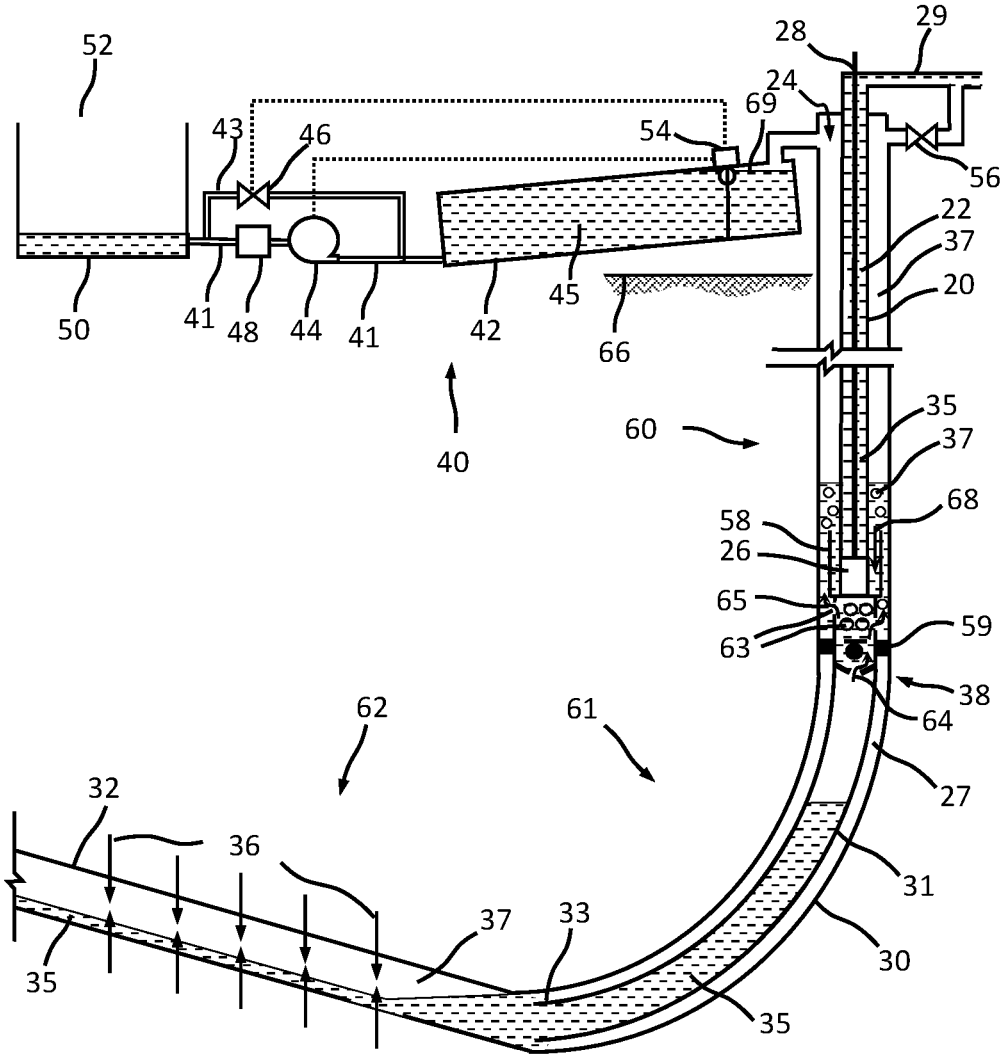
FIG. 1D is a schematic drawing of the first embodiment of FIG. 1A after opening the first one-way valve.

Operation—FIGS. 1B,1C,1D—First Embodiment

In accordance with the first embodiment, the system illustrated in FIG. 1A removes reservoir fluids 36 from the horizontal wellbore as follows:

First, in FIG. 1B a predetermined amount of one or more liquids 35 is displaced from production conduit 31 through valve 38 and perforations 63 into annular space 24 by gas 37 which is expanded in gas-containing section 32 and is discharged into production conduit 31. For this purpose, valve 46 is kept sufficiently open such that working fluid 45 is displaced from the first vessel 42 through bypass line 43 into the second vessel 50 by gas 37 entering first vessel 42 from annular space 24 and the pressure in gas-containing section 32 is reduced.

Next, in FIG. 1C the predetermined amount of one or more liquids 35 is pumped from annular space 24 into tubing 22 by means of downhole pump 26. For this purpose, valve 46 is kept substantially closed and working fluid 45 is pumped through connecting line 41 by working-fluid pump 44 from second vessel 50 into first vessel 42 to displace a substantial amount of the second predetermined volume of gas 37*a* back into annular space 24 such that valve 38 is kept substantially closed. Meanwhile one or more liquids 35 accumulates in gas-containing section 32 and production conduit 31 since reservoir fluids 36 continue being produced; gas 37 discharged from gas-containing section 32 is moved through production conduit 31 toward valve 38. Once the pressure in production conduit 31 below valve 38 becomes sufficiently high, valve 38 opens releasing gas 37 into annular space 24, as represented by arrow 64 and arrows 65 in FIG. 1D. As a result, gas 37 rises up through annular space 24 toward surface 66; one or more liquids 35 accumulated in gas-containing section 32 is displaced into production conduit 31.

Once a next predetermined amount of one or more liquids 35 is accumulated in production conduit 31, the processes of FIGS. 1B, 1C, and 1D are repeated as many times as desired.

Also, gas 37 may evolve from one or more liquids 35 in production conduit 31, annular space 24, and tubing 22 (the gas evolved in production conduit 31 and tubing 22 is not shown).

Moreover, a controller 54 including a working-fluid level sensor may be provided. The functions of controller 54 include: determining a working-fluid level 69 within first vessel 42; substantially opening valve 46 and turning off working-fluid pump 44, when working-fluid level 69 rises above a predetermined high level; and closing valve 46 and turning on working-fluid pump 44, when working-fluid level 69 falls below a predetermined low level, whereby the working fluid 45 is automatically displaced from first vessel 42 into second vessel 50 and vice versa in the processes related to FIG. 1B and FIG. 1C, respectively.

In addition, first vessel 42 may be substantially horizontally oriented and/or inclined upwardly toward vertical section 60.

FIGS. 1A, 1B,1C, 1D, 2—Additional Embodiments

Figure 2:
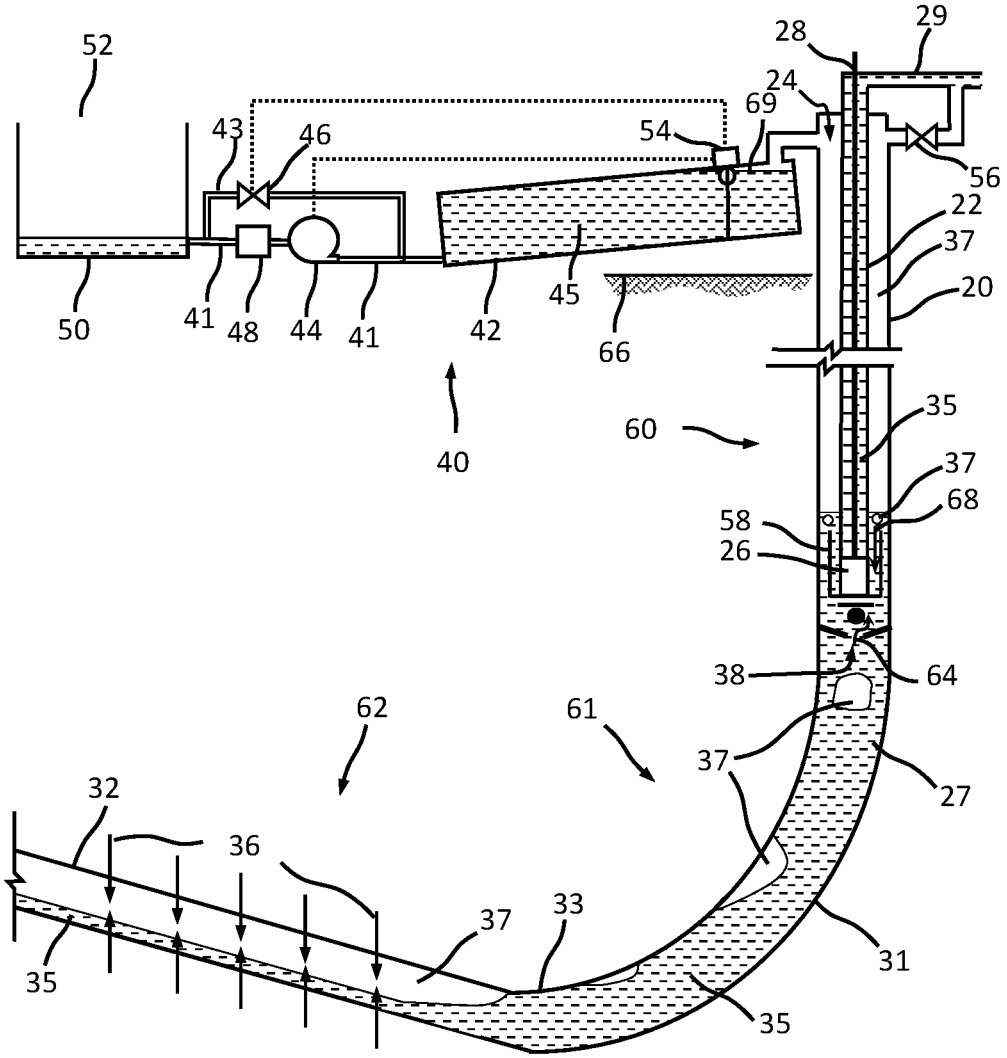
FIG. 2 is a schematic drawing of an additional embodiment of the system to remove substances from a horizontal wellbore in which the production conduit is attached to the casing.

FIG. 2 shows a schematic diagram of an additional embodiment which is the same as the first embodiment of FIG. 1A, except for the following differences. In FIG. 2 packer 59 of 1A and well conduit 30 of FIG. A are not included. Heel section 61 comprises production conduit 31 (e.g., an open-hole wellbore or the well tubular member known in the art as the liner) which is attached and fluidly connected to casing 20. The lower end 33 is connected to gas-containing section 32. Annular space 24 extends from valve 38 up to surface 66. The operation of the additional embodiment of FIG. 2 is the same as that of the first embodiment of FIG. 1A.

Another additional embodiment is the same as the first embodiment of FIG. 1A, except for the following differences. Valve 48 allows working fluid 45 to flow from first vessel 42 toward second vessel 50, but substantially prevents the flow of working fluid 45 in the opposite direction. The function of working-fluid pump 44 comprises pumping working fluid 45 from first vessel 42 through connecting line 41 into second vessel 50.

Operation—FIGS. 1B,1C, 1D—Another Additional Embodiment

In accordance with the another additional embodiment, the processes of removing reservoir fluids 36 from the horizontal wellbore are the same as those of FIGS. 1B,1C, and 1D, except for the following differences. Valve 48 allows working fluid 45 to flow from the first vessel 42 toward the second vessel 50, but substantially prevents the flow of working fluid 45 in the opposite direction. In the process of FIG. 1B, gas 37 is expanded in gas-containing section 32 and is discharged into production conduit 31 by suctioning gas 37 from annular space 24 to produce a low pressure (e.g., a negative gauge pressure) in annular space 24. For this purpose, valve 46 is kept closed and working fluid 45 is pumped from first vessel 42 through connecting line 41 into second vessel 50 by working-fluid pump 44. In the process of FIG. 1C, valve 46 is kept substantially opened and working fluid 45 is transported through bypass line 43 from second vessel 50 into first vessel 42 to displace from it gas 37 back into annular space 24.

Figure 3A:
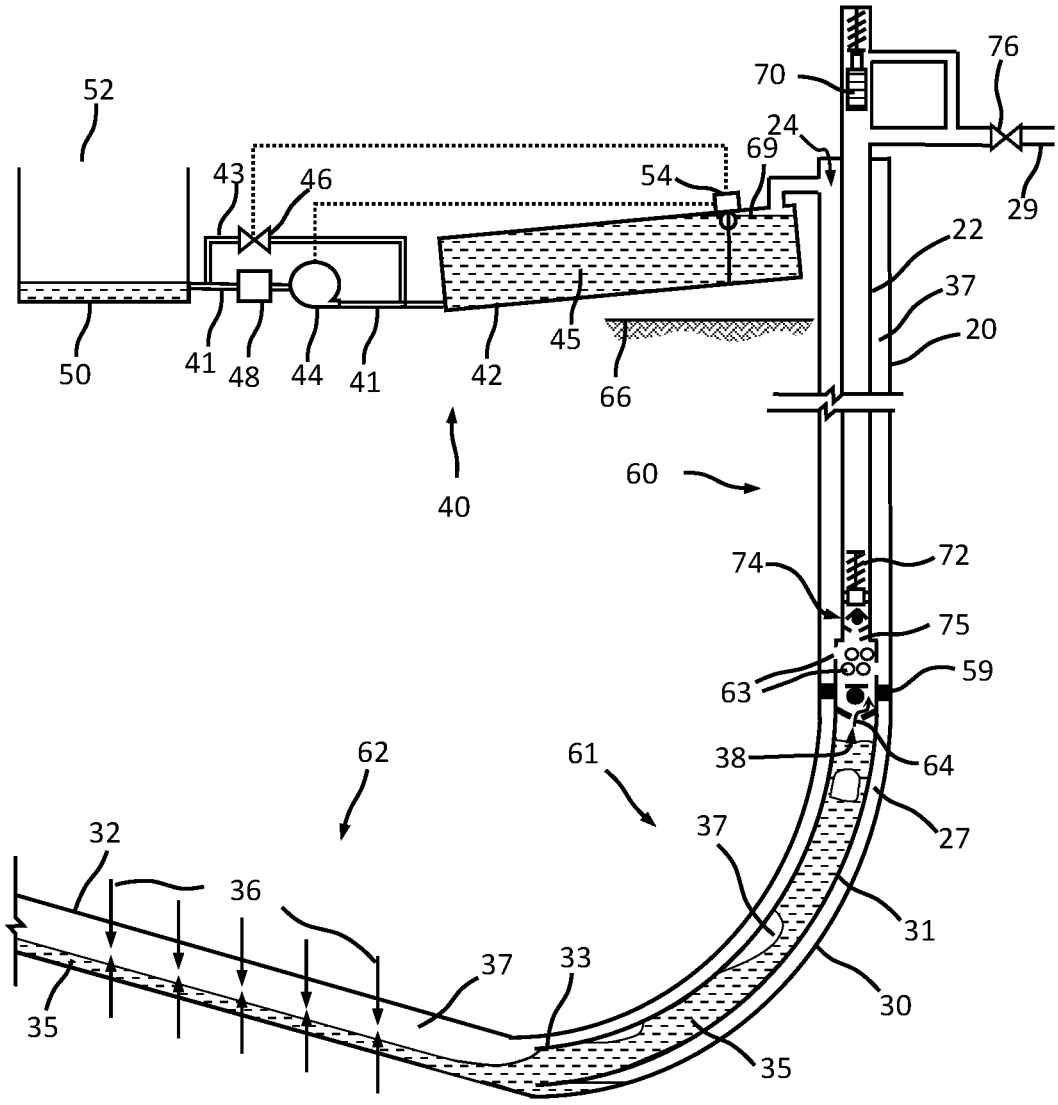
FIG. 3A is a schematic drawing of an alternative embodiment of a system to remove substances from a horizontal wellbore utilizing a tubing, a casing, a plunger, a downhole bumper spring, an annular space, a production conduit attached to the tubing, a first one-way valve disposed within the production conduit, and a fourth one-way valve disposed within the tubing.

FIG. 3A—Alternative Embodiments

An alternative embodiment, as shown in FIG. 3A, is the same as the first embodiment of FIG. 1A, except for the following differences. In FIG. 3A downhole pump 26 of FIG. 1A, sucker rod 28 of FIG. 1A, and valve 56 of FIG. 1A are not included. Production conduit 31 is attached to the end of tubing 22 nearest to the horizontal section 62. Tubing 22 has an inlet opening 75 disposed at its end nearest horizontal section 62. Production conduit 31 and tubing 22 fluidly communicates with each other through inlet opening 75. A fourth one-way valve 74 (e.g., a standing valve) is disposed at the end of tubing 22 nearest horizontal section 62 above inlet opening 75. Valve 74 allows gas 37 and/or one or more liquids 35, when present, to flow from production conduit 31, but substantially prevents the flow of gas 37 and/or one or more liquids 35, when present, in the opposite direction. A downhole bumper spring 72 is disposed within tubing 22 above valve 74. A free piston 70 is slidably disposed within tubing 22. Free piston 70 may also be referred to as a plunger. The downward movement of plunger 70 is limited by downhole bumper spring 72. Plunger 70 may be any device compatible with tubing 22. One such plunger is shown in U.S. Pat. No. 3,424,066 to E. K. Moore, Jr. which is incorporated by reference for all purposes in this written description. The end of tubing 22 nearest surface 66 is adapted to limit the upward movement of plunger 70. Also, at surface 66, tubing 22 and fluid-receiving conduit 29 may be connected through a second on/off valve 76 (known in the art as the motor valve).

At an initial operation state, as shown in FIG. 3A, the process may be the same as that of FIG. 1A, except for the following differences. Above valve 38, gas 37 enters tubing 22 through inlet opening 75 and continues to rise up through valve 74 and downhole bumper spring 72 toward surface 66, where it flows out into fluid-receiving conduit 29. Gas 37 substantially does not flow through annular space 24. Also, one or more liquids 35, when present (not shown), may enter tubing 22 through opening 75 and/or a portion of gas 37 may be condensed to form one or more liquids 35 (not shown) inside tubing 22. Plunger 70 is located at the end of tubing 22 nearest surface 66.

Operation—FIGS. 3B, 3C, 3D, 3E, 3F—Alternative Embodiment

Figure 3B:
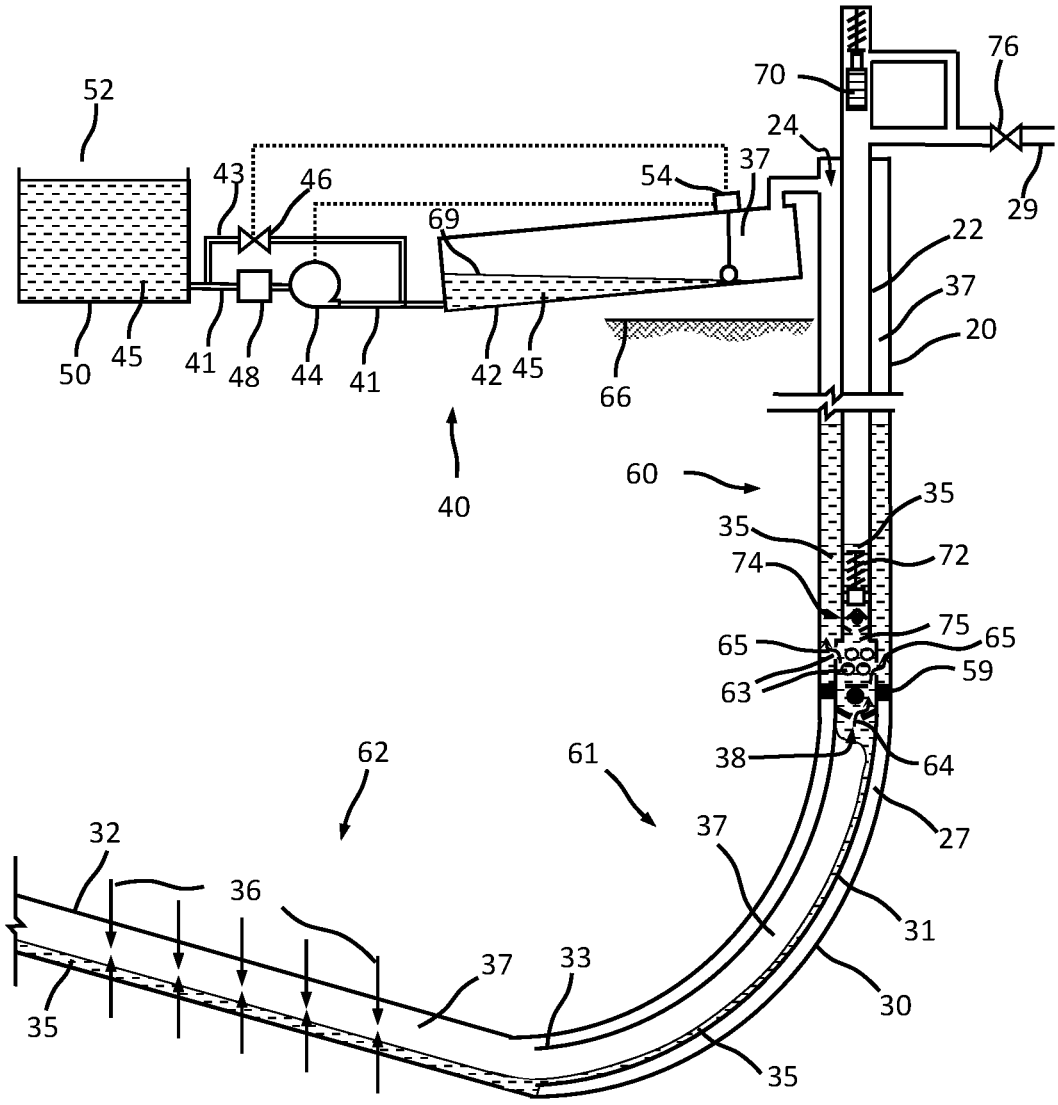
FIG. 3B is a schematic drawing of the alternative embodiment of FIG. 3A, when a predetermined amount of one or more liquids is displaced from the production conduit through the first one-way valve into the annular space.

In accordance with the alternative embodiment, the system illustrated in FIG. 3A removes reservoir fluids 36 from the horizontal wellbore as follows:

First, in FIG. 3B a predetermined amount of one or more liquids 35 is displaced from production conduit 31 through valve 38, as represented by arrow 64, and perforations 63, as represented by arrows 65, into annular space 24 by gas 37 which is expanded in gas-containing section 32 and is discharged into production conduit 31. For this purpose, valve 46 is kept sufficiently open such that working fluid 45 is displaced from first vessel 42 through bypass line 43 into second vessel 50 by a second predetermined volume of gas 37 entering first vessel 42 from annular space 24 and the pressure in gas-containing section 32 is reduced. Also, a fraction of the predetermined amount of one or more liquids 35, which is displaced from production conduit 31, may enter tubing 22 through inlet opening 75, if valve 74 is substantially open.

Figure 3C:
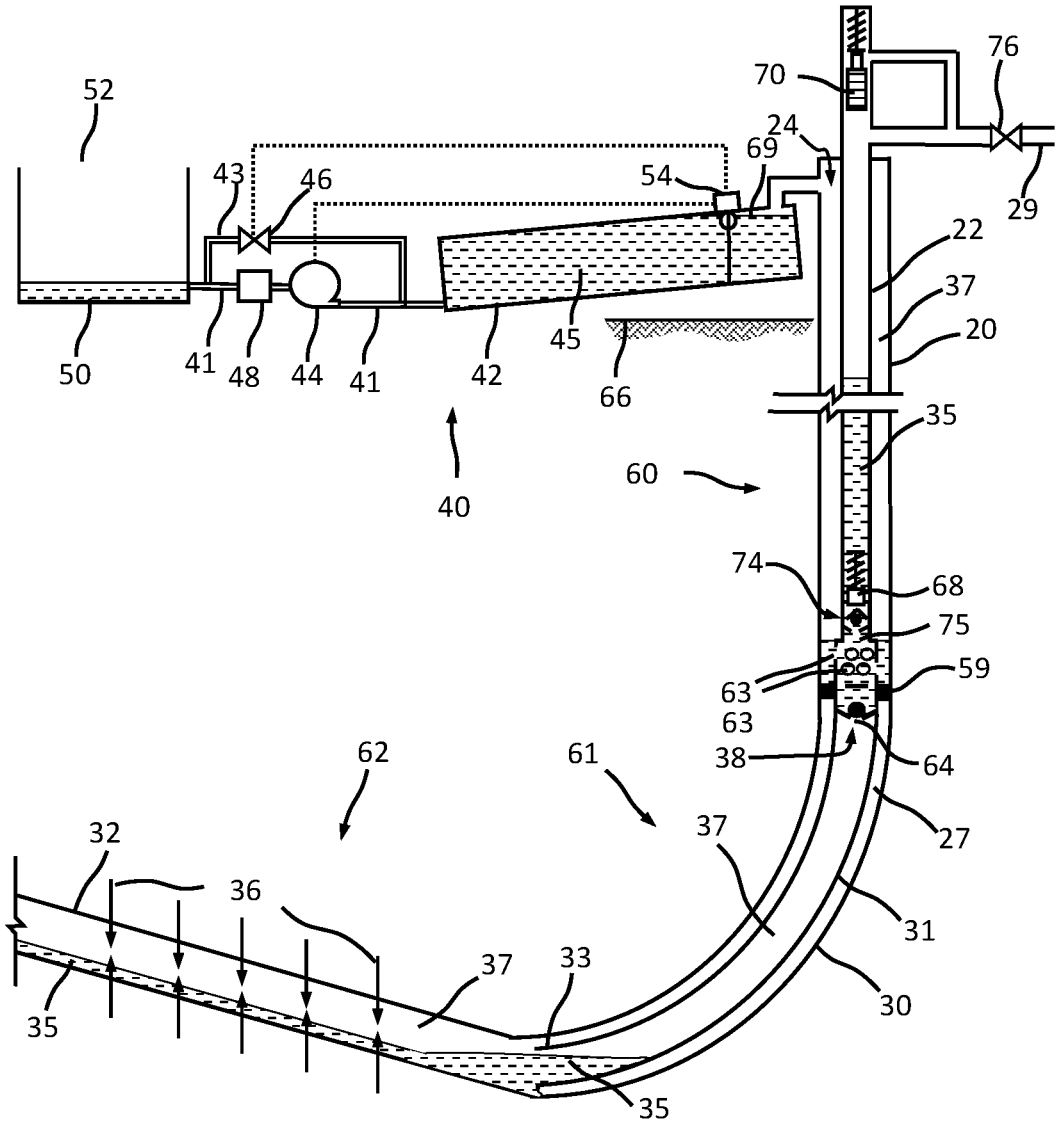
FIG. 3C is a schematic drawing of the alternative embodiment of FIG. 3A, when the predetermined amount of the one or more liquids is displaced from the annular space into the tubing through the fourth one-way valve.

Next, in FIG. 3C the displaced predetermined amount of one or more liquids 35 or its fraction located in annular space 24 is substantially displaced from annular space 24 through perforations 63, opening 75, and valve 74 into tubing 22. For this purpose, valve 46 is kept substantially closed and working fluid 45 is pumped through connecting line 41 by working-fluid pump 44 from second vessel 50 into first vessel 42 to displace the second predetermined volume of gas 37 back into the annular space 24 such that first valve 38 is kept substantially closed. Also, valve 76, if provided, may be kept substantially open. Meanwhile one or more liquids 35 and gas 37 accumulate in gas-containing section 32 and production conduit 31 since reservoir fluids 36 continue being produced.

Figure 3D:
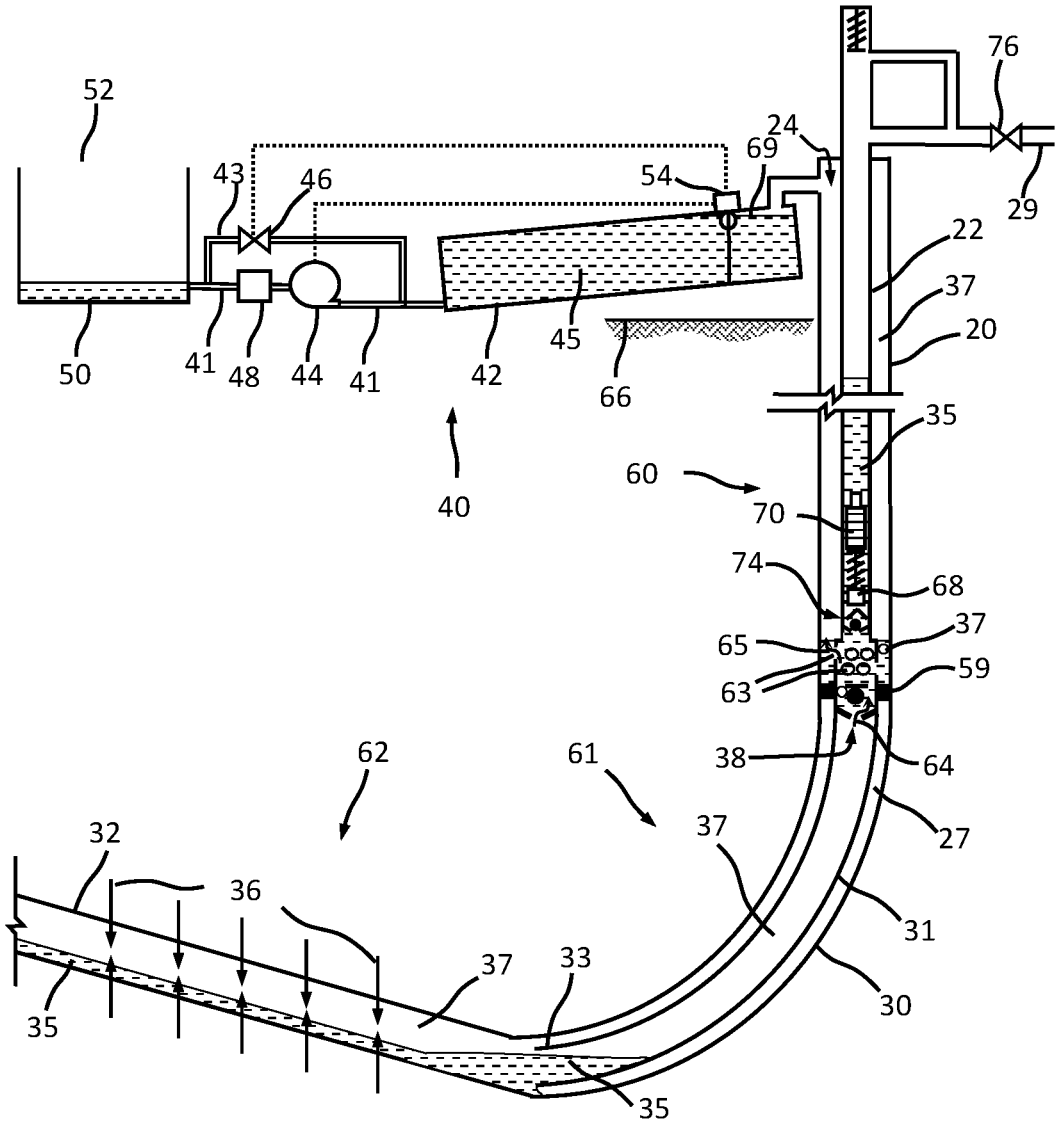
FIG. 3D is a schematic drawing of the alternative embodiment of FIG. 3A after falling the plunger to the downhole bumper spring.

Then, in FIG. 3D plunger 70 is allowed to fall to downhole bumper spring 72 and the predetermined amount of one or more liquids 35, or most of it, becomes located above plunger 70. Also, valve 76, if provided, may be kept substantially closed. Meanwhile one or more liquids 35 and gas 37 continue to accumulate in gas-containing section 32 and production conduit 31 since reservoir fluids 36 continue being produced. Once the pressure in production conduit 31 below valve 38 becomes sufficiently high, valve 38 opens, allowing gas 37 to enter annular space 24 through perforations 63.

Figure 3E:
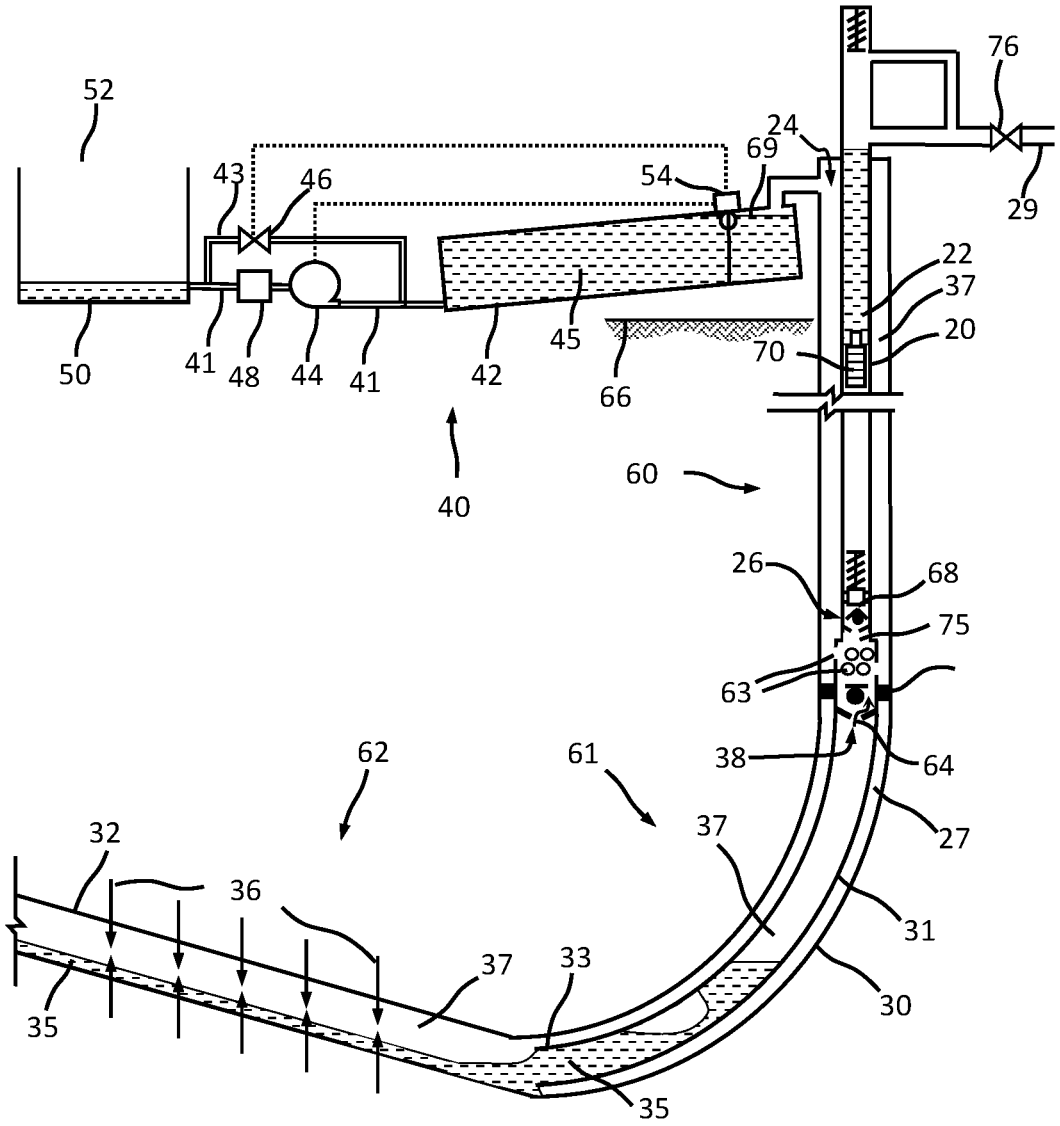
FIG. 3E is a schematic drawing of the alternative embodiment of FIG. 3A, when the plunger and the predetermined amount of one or more liquids are lifted to the surface.
Figure 3F:
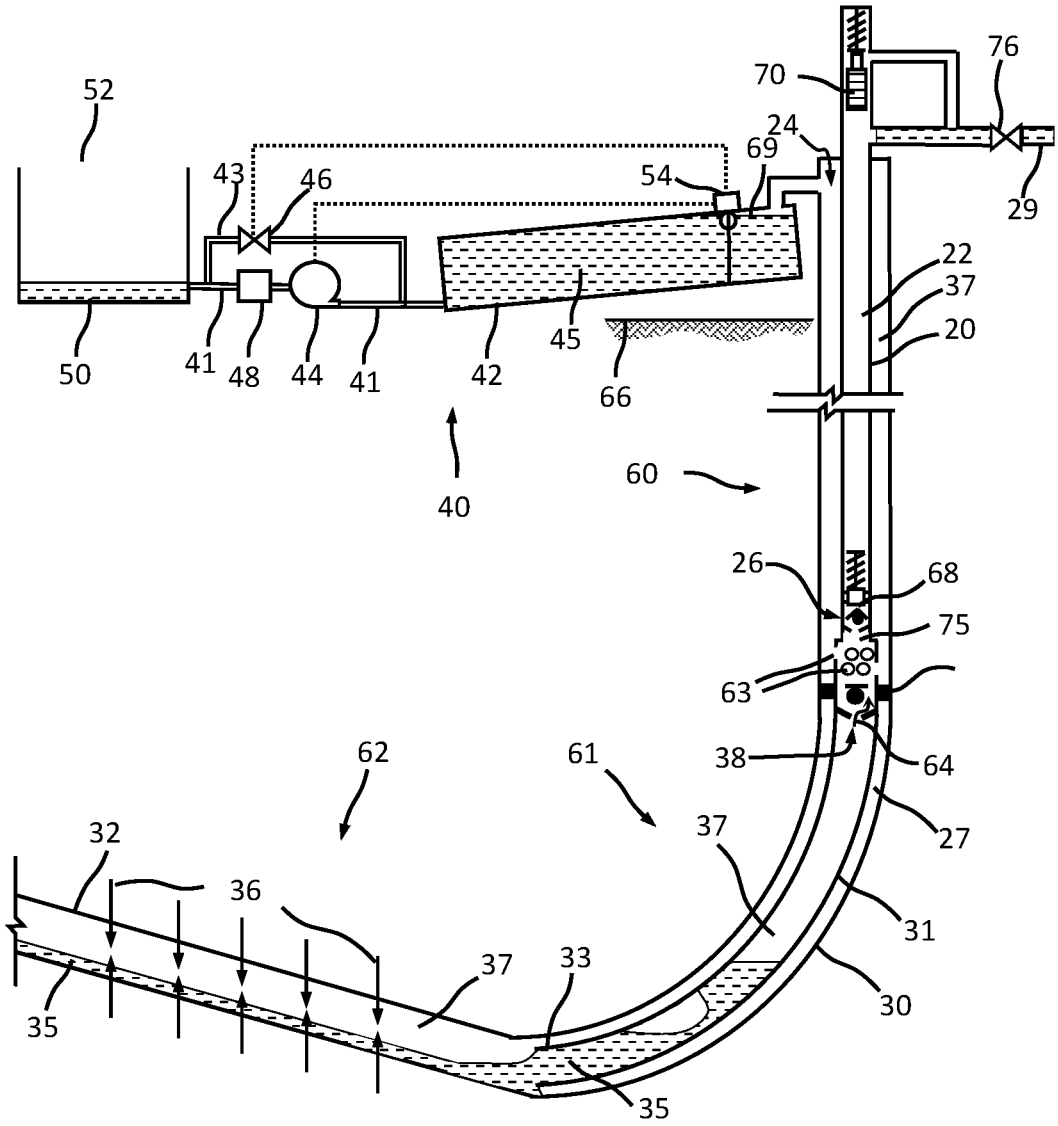
FIG. 3F is a schematic drawing of the alternative embodiment of FIG. 3A, when the predetermined amount of one or more liquids is removed from the tubing into a fluid-receiving conduit.

In FIG. 3E when a sufficient volume of gas 37 is accumulated and a sufficient pressure is reached in gas-containing section 32, production conduit 31, and annular space 24, gas 37 enters tubing 22 through opening 75 and eventually pushes plunger 70 upward from downhole bumper spring 72 toward surface 66. Also, valve 76, if provided, is kept substantially open. The predetermined amount of one or more liquids 35, or most of it, above the moving plunger 70 likewise moves up tubing 22 such that one or more liquids 35 are substantially removed from tubing 22 into fluid-receiving conduit 29, as shown in FIG. 3F. In this way, the plunger 70 essentially acts as a piston between one or more liquids 35 and gas 37 in tubing 22.

Once a next predetermined volume of one or more liquids 35 is accumulated in production conduit 31, the processes of FIGS. 3B, 3C, 3D, 3E, and 3F are repeated as many times as desired.

In another alternative embodiment (not shown), the plunger may comprise a ball and a piston which are falling separately from each other in the tubing in the process of FIG. 3D, allowing the gas and the one or more liquids to flow around the ball and through the piston. The ball and the piston join at the downhole bumper spring and are held together by the flow of the gas as it pushes them, now as one unit (as plunger 70 of FIG. 3E), and the one or more liquids above them toward the surface in the process of FIG. 3E.

Yet another alternative embodiment (not shown) is the same as that of FIG. 1A or FIG. 2 or FIG. 3A, except for reservoir fluids 36, which in this embodiment comprise solids (e.g., formation solids, sand, proppant, and the like) and/or unwanted fluids (e.g., a drilling mud, a control fluid, an acid stimulation fluid, and the like). Also, the solids and/or the unwanted fluids may be introduced into the horizontal section (e.g., for performing work over, drilling or other operations on the horizontal wellbore). The operation of the yet another alternative embodiment is similar to that described in FIG. 1B through FIG. 1D or in FIG. 3B through FIG. 3F, except that gas 37 is released from annular space 24 in the process of FIG. 1B or FIG. 3B at a sufficiently high rate to obtain a sufficiently high velocity of one or more liquids 35 toward vertical section 60 in horizontal section 62 and production conduit 31 such that the solids and/or the unwanted fluids are moved toward vertical section 60.

The first predetermined volume of the gas, the second predetermined volume of the gas, the predetermined amount of the one or more liquids, the predetermined maximum casing pressure, the predetermined low level, the predetermined high level, the sufficiently high rate, and the sufficiently high velocity can be readily determined by those skilled in the art.

The predetermined amount of the one or more liquids may be calculated using the following equation $$\frac{(p_c+\rho g h_{pc})(1-H_L)V_{hor}}{(1-H_L)V_{hor}+\Delta V}-\frac{p_c V_c}{V_c+V_{v1}-\Delta V(1+H_L)}-\rho g\left[h_{pc}-\frac{\Delta V(1-H_L)h_{pc}}{rA_cL_{pc}}+\frac{\Delta V(1+H_L)}{A_c}\right]=0, \quad \text{Eq. (1)}$$

where $$r=\frac{A_{pc}}{A_c},\ V_{hor}=L_{hor}\frac{\pi d_{hor}^2}{4},\ V_c=L_cA_c,\ A_c=\frac{\pi(d_c^2-d_t^2)}{4},$$

$\Delta V$=predetermined volume (amount) of the one or more liquids which are displaced from the production conduit into the annular space, $\rho$=density of the one or more liquids, g=acceleration of gravity, $A_c$=cross-sectional area of the annular space, $A_{pc}$=cross-sectional area of the production conduit, $L_c$=length of the annular space, $p_c$=pressure inside the annular space at the surface, $V_{hor}$=internal volume of the gas-containing section, $V_c$=volume of the annular space, $V_{v1}$=volume of the working fluid displaced from the first vessel into the second vessel when injecting the gas from the annular space into the first vessel, $h_{pc}$=vertical distance from the lower end of the production conduit to the upper end of the production conduit, $L_{pc}$=length of the production conduit $H_L$=volume fraction of one or more liquids in the gas-containing section (known in the art as the liquid holdup), $L_{hor}$=length of the gas-containing section, $V_{hor}$=internal volume of the gas-containing section, $L_c$ length of the casing $d_t$=outside diameter of the tubing $d_c$=inside diameter of the casing $d_{hor}$=inside diameter of the gas-containing section

Example—A System for a Horizontal Oil Well with a Downhole Pump

Table 1 shows an example of the calculation of the predetermined volume (amount) of liquids (oil and water) which are displaced from the production conduit into the annular space in a system for removing oil, water, and gas from a horizontal wellbore with a downhole pump.

TABLE 1

| | |
|---|---|
| Measured depth of the vertical portion (the length of the casing), m (ft) | 2438.4 (8000) |
| Inside diameter of the casing, m (in) | 0.1784 (7.025) |
| Outside diameter of the tubing, m (in) | 0.1143 (4.5) |
| Length of the gas-containing section, m (ft) | 2133.6 (7000) |
| Length of the production conduit, m (ft) | 365.76 (1200) |
| Vertical distance from the lower end of the production conduit to the upper end of the production conduit | 316.75 (1039.23) |
| Inside diameterof the horizontal section, m (ft) | 0.166 (6.538) |
| Liquid holdup in the horizontal section | 0.2 |
| Density of liquids kg/m$^3$ (lb/ft$^3$) | 900 (56.185) |
| Casing pressure(pressure inside the annular space at the surface), bar (psia) | 5 (72.519) |
| Average daily flow rate of liquids, m$^3$/s (barrels per day) | 0.000552 (300) |

TABLE 1-continued

| | |
|---|---|
| Volume of the working fluid displaced from the first vessel into the second vessel when injecting the gas from the annular space into the first vessel, $m^3$ (barrels) | 3.59 (22.5) |
| Inside diameter of the production conduit, m(in) | 0.100 (3.958) |
| Predetermined volume (amount) of the one or more liquids which is displaced from the production conduit into the annular space, calculated according to Eq. (1), $m^3$ (barrels) | 0.92 (5.78) |
| Frequency of repeatingthe operation comprising the processes of FIGS. 1B, 1C, 1D, 1/hour | 2.16 |

As can be seen in Table 1, the first vessel may have a relatively small internal volume (approximately 10% of the volume of the annular space) to produce the liquids at the specified flow rate by carrying out the operation comprising the processes of FIGS. 1B, 1C,1D approximately 2 times per hour.

Advantages

From the description, above, a number of advantages of some embodiments of my method and system become evident:

(a) The method and system will permit operators to recover any liquids that exist below the downhole equipment installed in the vertical section of the horizontal wellbore.

(b) The method and system may obviate the need for a source of pressurized gas (e.g. a compressor) to remove the reservoir fluids from the horizontal wellbore.

(c) The quantity of the one or more liquids entering the sucker-rod pump, if used, on each stroke (the pump "fillage") can be increased despite the sucker-rod pump is located in the vertical section and the one or more liquids are accumulated below it.

(d) The system may be compact, relatively small, and easy to transport from one well to another (e.g., the system can be portable or be used in applications where there are space limitations, for example, in offshore platforms).

(e) The pressure in the horizontal section is reduced when operating the system, whereby the production rate of the reservoir fluids from the reservoir can be increased.

(f) Suctioning the gas from the annular space may provide a negative gauge pressure in the annular space, thus increasing the production rate of the reservoir fluids from the reservoir.

(g) The amount of water, if produced, in the heel section can be reduced by releasing the gas from the annular space at a sufficiently high rate, whereby the pressure in the horizontal section can be reduced and consequently the production rate of the reservoir fluids from the reservoir can be increased.

(h) The method and system will permit the operators to remove the solids and the unwanted fluids from the horizontal section and the heel section without shutting in the horizontal wellbore.

(i) The proposed equation provides a basis for design and operation of the above embodiments.

CONCLUSION, RAMIFICATIONS, AND SCOPE

The method and system has been described in an illustrative manner, and it is to be understood that the terminology which has been used is intended to be in the nature of words of description rather than of limitation. Obviously, many modifications and variations of the present method and system are possible in light of the above teachings. For example, the means for injecting into and releasing from the annular space the gas may comprise a compressor and a conduit or a gas vessel being fluidly communicated with the casing. The function of the compressor comprises injecting the gas into the annular space, while the function of the conduit or the gas vessel includes receiving the gas being released from the annular space.

Furthermore, other artificial lift techniques can be used in the vertical section (velocity or siphon strings, gas lift, jet pump, wellhead compression, and others).

In addition, the reader will see that the system and method can be used for cleaning out a horizontal wellbore by operating the system for a period required to remove accumulations of the solids and/or the unwanted fluids from the horizontal wellbore, thus avoiding the need to shut in the horizontal wellbore for cleaning it out. It is, therefore, to be understood that within the scope of the appended claims, the method and system may be practiced otherwise than as specifically described.

What is claimed is:

1. An apparatus of removing substances from a horizontal well drilled from a surface, comprising:

a casing;

a tubing disposed within the casing;

a downhole pump connected to an end of the tubing;

a production conduit attached to the downhole pump;

a gas containing section of the well that leads to the production conduit, the gas containing section configured to accumulate a first predetermined volume of gas;

an annular space formed by the casing, tubing and production conduit; and a first one-way valve disposed within the production conduit and that leads to the annular space;

a first vessel, containing a working fluid, the first vessel in fluid communication with the first one way valve;

wherein the apparatus is configured to:

displace a predetermined amount of one or more substances from the production conduit through the first one-way valve into the annular space by the first predetermined volume of gas and the first predetermined volume of gas is discharged into the production conduit and wherein the working fluid is displaced from the first vessel by a second predetermined volume of gas entering the first vessel from the annular space;

pump the predetermined amount of one or more substances from the annular space into the tubing via the downhole pump; and release the first predetermined volume of gas into the annular space through the first one-way valve, once pressure in the production conduit becomes sufficiently high, which allows a substantially amount of the first predetermined volume of gas to rise up through the annular space towards the surface.

2. The apparatus of claim 1, wherein the production conduit has a flow opening comprising perforations, located between the downhole pump and a sealing mechanism, comprising a packer disposed between the production conduit and a well conduit;

wherein the one-way valve is configured to allow one or more liquids to flow from the production conduit through valve and then through perforations toward the annular space, but substantially prevents the flow of one or more liquids in an opposite direction.

3. The apparatus of claim 1, wherein:

the casing and tubing fluidly communicates with a fluid-receiving conduit at the surface;

a second one-way valve is disposed between casing and fluid-receiving conduit configured to limit the pressure in the annular space such that it does not exceed a predetermined maximum casing pressure;

wherein the second one-way valve is configured to allow the first predetermined volume of gas to flow from the annular space toward the fluid-receiving conduit, but substantially prevents the flow of the first predetermined volume of gas and one or more liquids in an opposite direction.

4. The apparatus of claim 1, wherein:

the first vessel has an upper end and a lower end;

a second vessel has a lower portion and an upper portion;

a connecting line is connected in parallel with a bypass line;

an opening is disposed in the upper portion of second vessel;

a connecting line is provided with a third one-way valve and a working-fluid pump;

a bypass line connected in parallel with the connecting line and the bypass line having a first on/off valve;

wherein the upper end of first vessel fluidly communicates with casing at the surface and the lower end of first vessel fluidly communicates with the lower part of second vessel via the connecting line;

wherein the third one-way valve is configured to allow the working fluid to flow from the second vessel toward the first vessel, but substantially prevent the flow of working fluid in an opposite direction;

wherein the second vessel fluidly communicates with Earth's atmosphere or with a reduced pressure environment through an opening.

5. The apparatus of claim 1, wherein the production conduit is attached and fluidly connected to the casing;

wherein a lower end of the production conduit is connected to the gas-containing section; and wherein the annular space extends from the first one-way valve up to the surface.

6. The apparatus of claim 1, wherein a third one-way valve is configured to allow the working fluid to flow from the first vessel toward a second vessel, but substantially prevents the flow of the working fluid in an opposite direction;

wherein a working-fluid pump comprises pumping the working fluid from the first vessel through a connecting line into the second vessel.

7. A method of removing substances from a well, comprising:

displacing a predetermined amount of one or more substances from a production conduit through a first one-way valve into an annular space by a first predetermined volume of gas and discharging the first predetermined volume of gas into the production conduit;

displacing a working fluid from a first vessel by a second predetermined volume of gas entering the first vessel from the annular space;

pumping the predetermined amount of one or more substances from the annular space into a tubing via a downhole pump; and releasing the first predetermined volume of gas into the annular space through the first one-way valve, once pressure in the production conduit becomes sufficiently high, which allows a substantial amount of the first predetermined volume of gas to rise up through and out of the annular space.

8. The method of claim 7, wherein the first predetermined volume of gas is discharged into the production conduit by suctioning the second predetermined volume of gas from the annular space to produce a low pressure in the annular space;

wherein a first on/off valve is kept closed and the working fluid is pumped from the first vessel through connecting line into a second vessel by a working-fluid pump.

9. The method of claim 8, wherein the first on/off valve is kept substantially opened and the working fluid is transported through a bypass line from the second vessel into the first vessel to displace a substantial amount of the second predetermined volume of gas back into the annular space.

10. An apparatus of removing substances from a horizontal well drilled from a surface, comprising:

a substantially horizontal section of the well;

a casing;

a tubing disposed within the casing, the tubing having an inlet opening disposed at an end nearest the horizontal section of the well;

a production conduit attached to the tubing nearest the horizontal section of the well, wherein the production conduit and tubing fluidly communicates with each other through inlet opening;

a fourth one-way valve disposed at the end of tubing nearest horizontal section above the inlet opening, wherein the fourth one-way valve is configured to allows a first predetermined volume of gas and/or one or more liquids, when present, to flow from the production conduit, but substantially prevent the flow of the first predetermined volume of gas and/or one or more liquids, when present, in the opposite direction;

a downhole bumper spring disposed within the tubing above the fourth one-way valve;

a plunger slidably disposed within tubing, wherein downward movement of the plunger is limited by the downhole bumper spring;

an annular space formed by the casing, tubing and production conduit; and a first one-way valve disposed within the production conduit and that leads to the annular space;

a first vessel, containing a working fluid, the first vessel in fluid communication with the first one way valve;

wherein the apparatus is configured to:

permit the first predetermined volume of gas to enter the tubing through the inlet opening and continue to rise up through the fourth one-way valve and downhole bumper spring toward the surface, where it flows out into fluid-receiving conduit;

wherein the first predetermined volume of gas substantially does not flow through the annular space.

11. The apparatus of claim 10, wherein the end of the tubing nearest the surface is adapted to limit the upward movement of plunger.

12. The apparatus of claim 10, wherein at the surface, the tubing and a fluid-receiving conduit are connected through a second on/off valve.

13. The apparatus of claim 10 wherein the plunger is located at the end of tubing nearest surface.

14. A method of removing substances from a well, comprising:

displacing a predetermined amount of one or more substances from a production conduit through a first one way-valve into an annular space gas by a first predetermined volume of gas and discharging the first predetermined volume of gas into the production conduit;

displacing a working fluid from a first vessel into a second vessel by a second predetermined volume of gas entering the first vessel from the annular space and reducing the pressure in a gas-containing section;

displacing the predetermined amount of one or more substances from the annular space into the tubing;

pumping the working fluid through a connecting line into a first vessel to displace a substantial amount of the second predetermined volume of gas back into the annular space such that the one or more substances and first predetermined volume of gas accumulate in the gas-containing section and production conduit;

wherein a plunger falls to a downhole bumper spring and at least some of the predetermined amount of one or more substances becomes located above the plunger;

wherein once pressure in the production conduit below the one-way valve becomes sufficiently high, the one-way valve opens, allowing the first predetermined volume of gas to enter the annular space;

wherein when a sufficient amount of the first predetermined volume of gas is accumulated and a sufficient pressure is reached in the gas-containing section, production conduit, and annular space, the first predetermined volume of gas enters through the tubing and pushes the plunger upward from the downhole bumper spring toward the surface;

wherein at least some of the predetermined amount of one or more substances above the moving plunger moves up tubing such that one or more substances are substantially removed from the tubing and into the fluid-receiving conduit.

15. The method claim 14, wherein a first on/off valve is kept sufficiently open such that the working fluid is displaced from the first vessel through a bypass line and into a second vessel by the first predetermined volume of gas entering the first vessel from the annular space and the pressure in the gas-containing section is reduced.

16. The method claim 14, wherein a fraction of the predetermined amount of one or more substances, which is displaced from production conduit enters the tubing through the inlet opening, if a fourth one-way valve is substantially open.

17. The method claim 14, wherein displacing the predetermined amount of one or more substances from the annular space comprises displacing the predetermined amount of one or more substances through perforations, an opening, and a fourth one-way valve and into the tubing.

18. The method of claim 14, wherein pumping the working fluid through a connecting line into a first vessel comprises displacing a substantial amount of the second predetermined volume of gas back into the annular space such that first one-way valve is kept substantially closed.

19. The method of claim 14, wherein a second on/off valve is kept substantially open when displacing the predetermined amount of one or more substances from the annular space into the tubing.

20. The method of claim 14, wherein a second on/off valve is kept substantially closed when the plunger falls to a downhole bumper spring and at least some of the predetermined amount of one or more substances becomes located above the plunger.

* * * * *